United States Patent [19]

Plasko, Jr.

[11] 4,035,110

[45] July 12, 1977

[54] AIR COMPRESSOR CYLINDER HEAD

[75] Inventor: Rudolph J. Plasko, Jr., Elyria, Ohio

[73] Assignee: The Bendix Corporation, South Bend, Ind.

[21] Appl. No.: 615,443

[22] Filed: Sept. 22, 1975

[51] Int. Cl.[2] ..... F01B 31/08; F04B 39/06

[52] U.S. Cl. ..... 417/539; 92/144; 417/454

[58] Field of Search ..... 92/144; 417/298, 454, 417/539, 434

[56] References Cited

U.S. PATENT DOCUMENTS

| | | | |
|---|---|---|---|
| 706,979 | 8/1902 | Martin | 417/243 |
| 770,785 | 9/1904 | Steedman | 417/298 |
| 1,159,123 | 11/1915 | Steedman | 417/454 |
| 1,493,935 | 5/1924 | Hack | 417/539 |
| 1,789,376 | 1/1931 | White | 417/539 |
| 1,838,259 | 12/1931 | Hull | 92/144 |
| 1,870,219 | 8/1932 | Aikman | 417/534 |
| 2,084,670 | 6/1937 | Crittenden | 92/144 |
| 2,283,317 | 5/1942 | Cumisk | 92/144 |
| 2,751,144 | 6/1956 | Troendle | 92/144 |

*Primary Examiner*—William L. Freeh
*Attorney, Agent, or Firm*—Ken C. Decker; William N. Antonis; Paul D. Schoenle

[57] ABSTRACT

An air compressor cylinder head is disclosed in which a compressed air jacket surrounds a coolant-receiving cavity instead of the coolant surrounding the air jacket as in the prior art. This arrangement permits the compressed air to be cooled by heat transfer both to the ambient air and to the coolant in the coolant cavity, instead of to the coolant alone, as in the prior art.

3 Claims, 4 Drawing Figures

AIR COMPRESSOR CYLINDER HEAD

BACKGROUND OF THE INVENTION

This invention relates to a cylinder head for an automotive air compressor.

Automotive air compressors have been used for many years on vehicles equipped with air brakes. A recurring problem with this type of air compressor is the fact that relatively high discharge air temperature leads to carbon formation in the compressors. Many different designs have been proposed in an effort to reduce the air temperature in the cylinder head, especially around the compressor valving where carbon formation is especially detrimental.

The air compressor in the cylinder head disclosed herein differs from the conventional head in that an air jacket is provided around a cavity which is supplied with the engine coolant. The water cavity is also located directly above the cylinder bores where the greatest heat gradient exists and therefore the greatest amount of heat transfer will occur.

SUMMARY OF THE INVENTION

Therefore, an important object of my invention is to substantially increase the area of the interface between the discharge compressed air and the coolant in the coolant-containing cavity in an automotive air compressor cylinder head.

Another important object of my invention is to enclose the coolant-containing cavity of an air compressor within the compressed air-receiving cavity, so that heat may be transferred from the compressed air both to the coolant and to the ambient air.

Another important object of my invention is to locate the coolant-receiving cavity of an air compressor directly above the cylinder walls so that the latter will be cooled efficiently.

DETAILED DESCRIPTION

Figure 1:
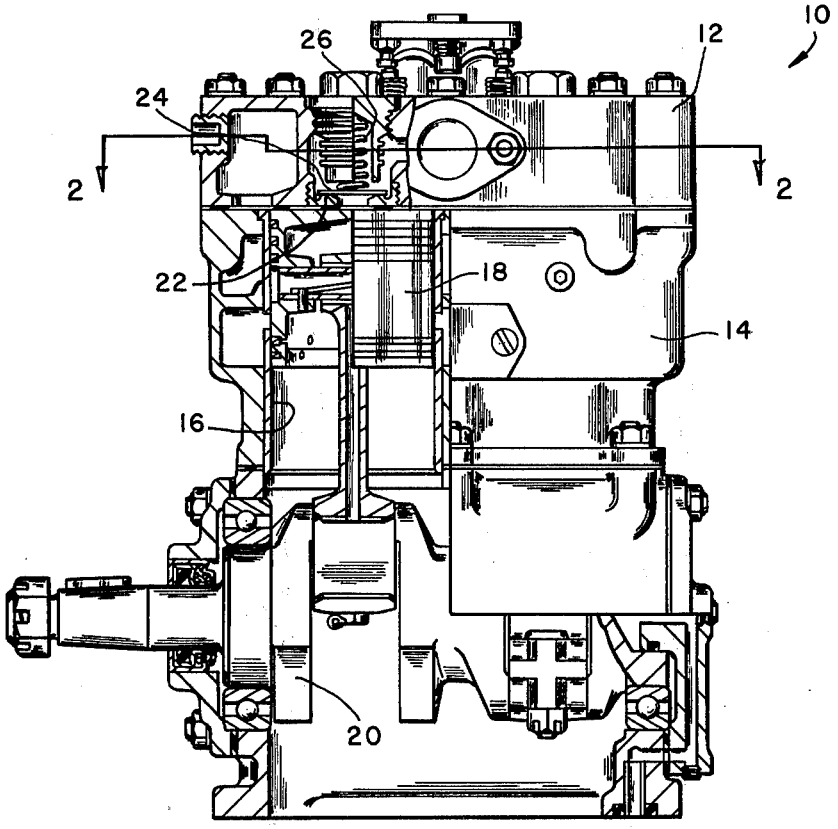
FIG. 1 is a side elevational view, partly in section, of an air compressor for an automotive vehicle which includes a cylinder head made pursuant to the teachings of my present invention.
Figure 4:
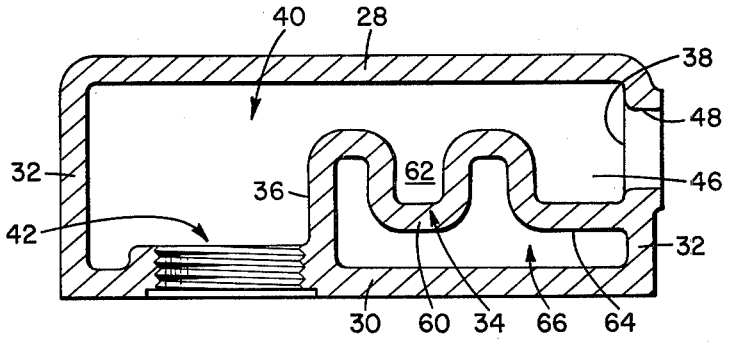
FIG. 4 is a view taken substantially along line 4—4 of FIG. 2.

Referring now to the drawing, an air compressor generally indicated by the numeral 10 includes a head 12 and a cylinder block 14. Cylinder block 14 is provided with one or more cylinder bores 16 which slidably receive a piston 18. A crankshaft 20 is rotatably mounted within the block 14, and the pistons 18 are connected to the crankshaft 20 in the appropriate manner well known to those skilled in the art. The crankshaft 20 is turned by the engine (not shown) of the vehicle on which the compressor 10 is mounted. The cylinder head 12 includes a valve seat 22 and valve member 24 for each of the pistons 18. A spring 26 yieldably urges the valve member 24 into sealing engagement with valve seat 22 to prevent communication from the variable volume chamber above the piston 18 into the cylinder head 12 until a predetermined pressure level is achieved. Valve seat 22 and valve member 24 are commonly called the compressor discharge valving. On the downward stroke of the piston 18, atmospheric air is sucked into the cylinder for compression on the upward stroke of the piston.

Figure 2:
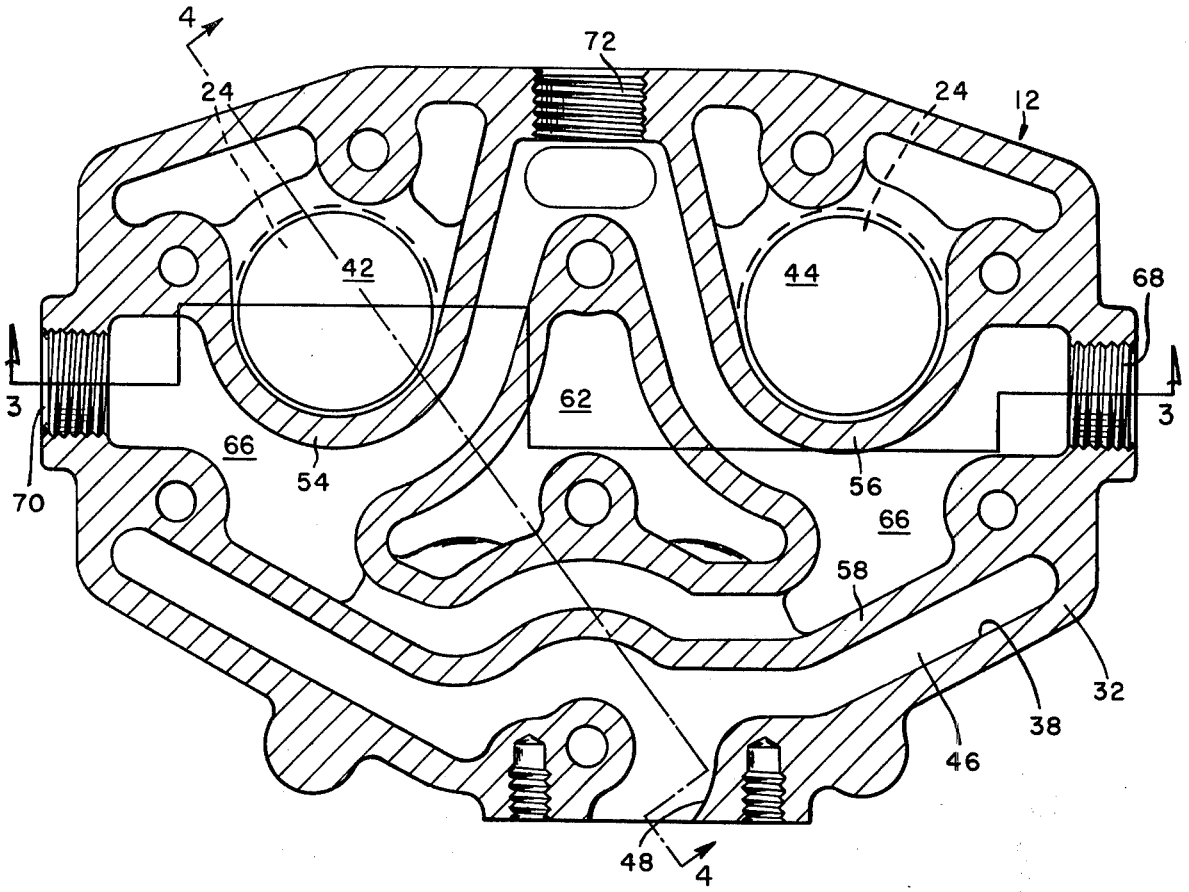
FIG. 2 is a view taken substantially along a line 2—2 of FIG. 1.
Figure 3:
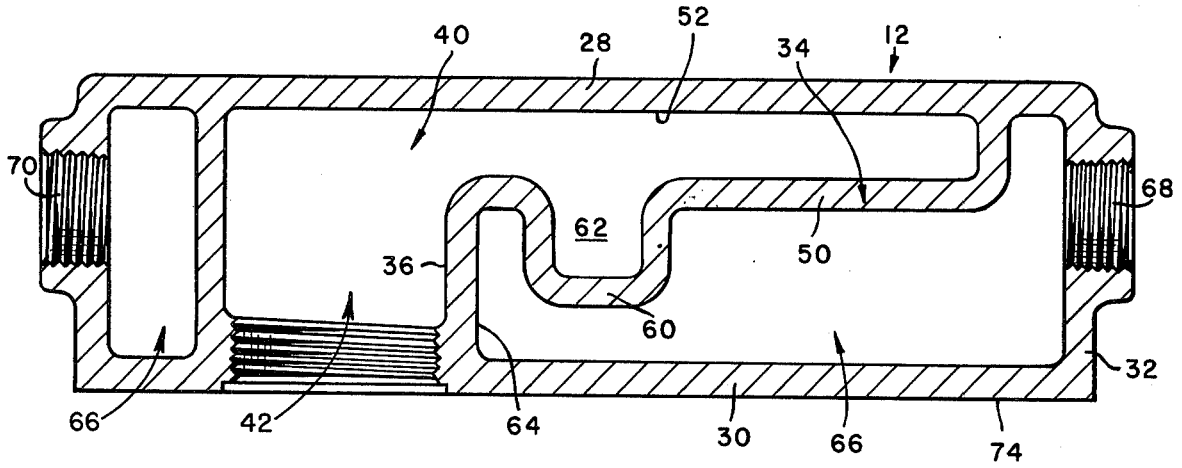
FIG. 3 is a view taken substantially along line 3—3 of FIG. 2.

Referring now to FIGS. 2 and 3, the cylinder head 12 includes an upper wall 28, a lower wall 30, and an outer peripheral wall 32 which interconnects the upper and lower walls 28 and 30. An inner peripheral wall generally indicated by the numeral 34 also interconnects the upper and lower walls 28 and 30 and presents an outer surface 36 which cooperates with the inner surface 38 of the outer peripheral wall 32 to define a compressed air-receiving cavity generally indicated by the numeral 40. As can be seen in FIG. 2, compressed-air cavity 40 includes a first section 42 overlying one of the compressor discharge valves 24, a second section 44 overlying the other compressor discharge valve 24, and a third section 46 which communicates with the air discharge port 48 which communicates the compressed air-receiving cavity 40 with the appropriate storage reservoir (not shown) which is carried on the vehicle. As can best be seen in FIG. 3, the inner peripheral wall 34 also includes a transversely extending portion 50 which cooperates with the inner surface 52 of the upper wall 28 to define a chamber therebetween which connects each of the chambers 42, 44, and 46 of the compressed air-receiving cavity 40. The inner peripheral wall 34 includes portions 54, 56, and 58 which cooperate with the outer peripheral wall 32 to define the cavity sections 42, 44, and 46, respectively, of the compressed air-receiving cavity 40. The inner peripheral 34 furthermore is provided with a depression 60 which defines another section 62 of the compressed air-receiving cavity 40 to increase the surface area of the latter.

The inner suface 64 of the inner peripheral wall 34 cooperates with the lower wall 30 to define a coolant-receiving cavity generally indicated by the numeral 66. Consequently, the coolant-receiving cavity 66 is defined generally below and within the compressed air-receiving cavity 40. The coolant-receiving cavity 66 is provided with ports 68, 70, and 72 which are connected to the vehicle radiator so that coolant fluid can be circulated through the coolant-receiving cavity 66.

It will be noted that the compresed air-receiving cavity 40 is defined generally between the inner surface of the outer peripheral wall 32, the inner surface of the other wall 28, and the outer surface of the inner peripheral wall 34. Of course, the outer surfaces of the outer peripheral wall 32 and the upper wall 28 are all exposed to atmospheric air. Consequently, heat can be transferred from the compressed air in the compressed air-receiving cavity 40 to the ambient air through the walls 28 and 32. On the other hand, the design of the inner peripheral wall 34 is such that a relatively large surface of this wall is exposed both to the compressed air in the compressed air-receiving cavity 40 and to the coolant in the cavity 66. Since the heat transfer, and therefore the rate at which the compressed air in the cavity 40 is cooled, depends upon the surface area exposed to the fluid in both cavities, the design of the wall 34 provides the maximum amount of heat transfer between the compressed air-receiving cavity 40 and the coolant-receiving cavity 66. Additional cooling of the compressed air in cavity 40 is provided by heat transfer to the ambient air as discussed hereinabove. It will also be noted that the coolant-receiving cavity 66 is defined generally between the inner surface of lower wall 30 and by the inner surface 64 of the inner peripheral 34, so that, except for the area taken up by the ports 68, 70, and 72, very little of the peripheral walls of the coolant-receiving cavity 66 are defined by the outer peripheral wall 32 of the cylinder head 12. Of course, the outer surface 74 of the lower wall 30 is disposed adjacent the upper edge of the cylinder block 14. As illustrated in the Figures, the largest portion of the inner surface of wall 30 is exposed to the coolant in cavity 66. Obviously, the area of the sections 42, 44, and 46 of the cavity defined by the lower wall 30 is much less than the area of the coolant-receiving cavity 66 which is defined by the inner surface of the lower wall 30. Consequently, the greater portion of the uppermost ends of the cylinder bores 16 are exposed to the coolant in the coolant-receiving cavity 66. Since the temperature gradient is largest between the cylinder walls 16 and the coolant-receiving cavity 66, the maximum amount of heat transfer will take place therebetween, thereby assuring efficient cooling of the cylinder bores 16 and also of the discharge valves 24. On the other hand, the maximum cooling of the compressed air in the receiving cavity 40 is assured because of the heat transfer between the compressed air in the latter in the coolant-receiving cavity 66 and also between the cavity 40 and the ambient air. Prior art cylinder heads generally surrounded the compressed air discharge cavity with the coolant water jacket, so that heat transfer could generally take place only between the compressed air and the coolant. In the present invention, heat transfer not only occurs between the compressed air and the coolant, but also between the compressed air and the ambient air, thereby substantially increasing cooling efficiency.

I claim:

1. In an air compressor, a housing defining a cylinder therein, a piston slidably mounted in said cylinder, a head assembly for said housing having coolant-receiving and compressed air-receiving cavities therein, and valve means for controlling communication between said cylinder and said compressed air-receiving cavity, said head assembly including an upper wall having an outer surface communicating with ambient air, a lower wall, an outer wall interconnecting said upper and lower walls and having an outer surface communicating with ambient air, and an inner wall having a portion thereof extending transversely with respect to the outer wall between said upper wall and said lower wall, said inner wall cooperating with the other walls to define said compressed air-receiving and coolant-receiving cavities therebetween, one of said cavities being disposed generally above and the other of said cavities being disposed generally below said transversely extending portion, said cavity above said transversely extending portion being said compressed air-receiving cavity, the cavity below said transversely extending portion being said coolant-receiving cavity, said inner wall transversely extending portion being substantially parallel to said upper wall and cooperating with said upper wall to substantially define said compressed air-receiving cavity therebetween.

2. In an air compressor, a housing defining a cylinder therein, a piston slidably mounted in said cylinder, a head assembly for said housing having coolant-receiving and compressed air-receiving cavities therein, and valve means for controlling communication between said cylinder and said compressed air-receiving cavity, said head assembly including an upper wall, a lower wall, an outer wall interconnecting said upper and lower walls, an inner wall between said upper wall and said lower wall cooperating with the lower wall and the outer wall to substantially define said coolant-receiving cavity therebetween, and inlet and outlet port means on the outer wall communicating coolant fluid through said last-mentioned cavity, said inner wall having a transversely extending wall portion that is substantially parallel to the upper wall and cooperating with the upper wall and the outer wall to substantially define said compressed air-receiving cavity.

3. The air compressor of claim 2 in which said inner wall interconnects with a portion of the outer wall and said inlet and outlet port means are disposed on the other portion of the outer wall.

* * * * *